US007510106B2

(12) United States Patent
Manabe

(10) Patent No.: US 7,510,106 B2
(45) Date of Patent: Mar. 31, 2009

(54) DRIVER STRUCTURE OF STAPLER

(75) Inventor: Katsunori Manabe, Tokyo (JP)

(73) Assignee: MAX Co., Ltd., Tokyo (JP)

( * ) Notice: Subject to any disclaimer, the term of this patent is extended or adjusted under 35 U.S.C. 154(b) by 0 days.

(21) Appl. No.: 10/524,710

(22) PCT Filed: Jul. 18, 2003

(86) PCT No.: PCT/JP03/09137

§ 371 (c)(1),
(2), (4) Date: Jan. 19, 2005

(87) PCT Pub. No.: WO2004/009296

PCT Pub. Date: Jan. 29, 2004

(65) Prior Publication Data

US 2006/0006208 A1 Jan. 12, 2006

(30) Foreign Application Priority Data

Jul. 19, 2002 (JP) ..... 2002-210923

(51) Int. Cl.
*B27F 7/19* (2006.01)
*B25C 5/02* (2006.01)

(52) U.S. Cl. ..... 227/107; 227/120; 227/147; 227/156; 411/442; 411/920

(58) Field of Classification Search ..... 227/107, 227/156, 120, 147; 411/442, 920
See application file for complete search history.

(56) References Cited

U.S. PATENT DOCUMENTS 2,351,045 A * 6/1944 Heller ..... 411/920
2,923,938 A * 2/1960 Rinehardt ..... 227/146
3,524,575 A * 8/1970 Hurkmans et al. ..... 227/131
4,043,504 A * 8/1977 Hueil et al. ..... 227/116
4,747,531 A * 5/1988 Brinkerhoff et al. ..... 227/19
4,919,320 A 4/1990 Storace
5,941,440 A * 8/1999 Ohmae et al. ..... 227/119
6,071,053 A * 6/2000 Kuhns ..... 411/442
6,474,633 B1 * 11/2002 Hirai ..... 227/120
7,011,242 B2 * 3/2006 Barlow et al. ..... 227/120

FOREIGN PATENT DOCUMENTS

DE 36 41 477 A1 6/1988
FR 846928 9/1939

(Continued)

*Primary Examiner*—Stephen F Gerrity
(74) *Attorney, Agent, or Firm*—Chapman and Cutler LLP

(57) ABSTRACT

A driver structure configured to drive a U-character shaped staple including a pair of leg portions configured to pass through a bundle of papers and a crown for connecting the leg portions, the driver structure including a blade edge disposed to be in contact with the staple, first projecting parts provided at opposite end portions of the blade edge and disposed to be in contact with a corner between the crown and each of the leg portions for pressing the leg portions perpendicularly when the pair of leg portions pass through the papers, and second projecting parts provided on the blade edge in vicinity of the first projecting parts and configured to hold the crown in vicinity of the pair of leg portions when the pair of leg portions pass through the bundle of papers, each of the second projecting parts having a corner portion to engage with the crown.

1 Claim, 3 Drawing Sheets

FOREIGN PATENT DOCUMENTS

| | | |
|---|---|---|
| FR | 969859 | 12/1950 |
| JP | 46-26230 | 9/1971 |
| JP | 48-61476 | 8/1973 |
| JP | 63-162168 | 7/1988 |
| JP | 09-085644 | 3/1997 |
| JP | 09-174454 | 7/1997 |
| JP | 10-146803 | 6/1998 |
| JP | 2003-513812 | 4/2003 |
| WO | WO 01/36162 A1 | 5/2001 |

* cited by examiner

PRIOR ART
FIG.5
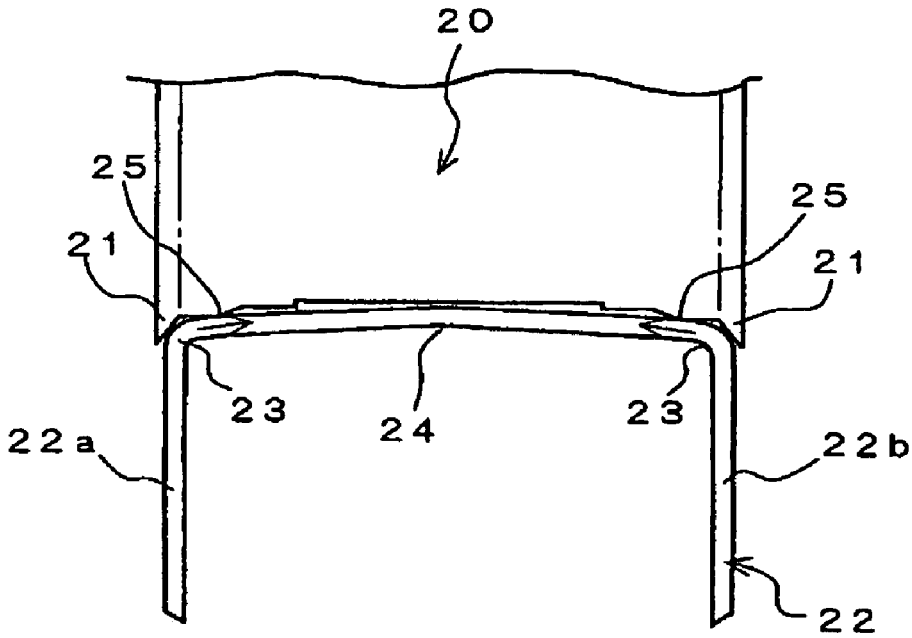
FIG.6(A)
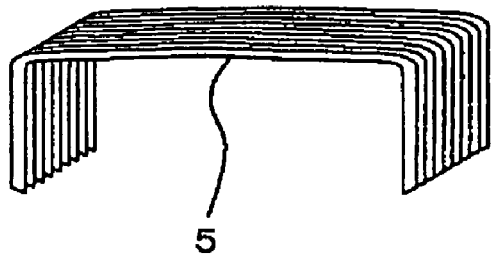
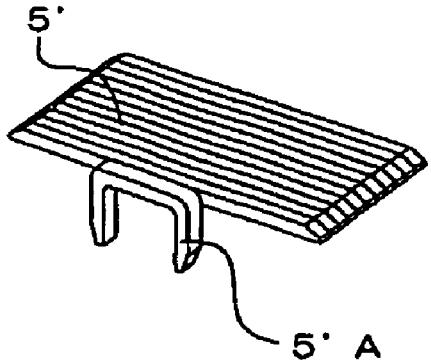
FIG.6(B)

DRIVER STRUCTURE OF STAPLER

TECHNICAL FIELD

The present invention relates to a driver structure for a stapler to staple a bundle of papers or the like by a staple, more specifically, to a driver structure for a stapler, configured to prevent a failure of stapling that caused by the buckling of the leg portions of the staple when stapling a bundle of papers.

BACKGROUND ART

Conventionally, there has been known a manual stapler or a stapler of a type set in a copying machine or the like as a stapler for stapling a bundle of papers such as copy papers or the like. Such a stapler includes a thin-plated driver for driving a U-character shaped staple having a pair of leg portions passing through the bundle of papers and a crown for connecting the leg portions into the bundle of papers. If a blade edge of the driver is flat, there is a problem that a load is imparted on the leg portions of the staple when stapling thick papers or the like, a buckling occurs on the leg portions or the crown, in this way, the staple is easy to deform.

Therefore, there has been known a stapler in which projecting parts 21 are formed on opposite ends of a blade edge 20 in the driver, as shown in FIG. 5, and the projecting parts hold portions near corners 23 which are roots of leg portions 22*a* and 22*b* of a staple 22 so that the leg portions do not move outwardly. In addition, projecting portions 25 are provided in the vicinity of the projecting parts 21 in the blade edge 20.

However, the projecting portions 25 have no functions in which both the leg portions 22*a* and 22*b* are prevented from falling down inwardly with respect to each other and hold a crown 24 connecting the leg portions 22*a* and 22*b* by engaging the projecting portions with the crown 24.

Consequently, when driving the staple in bundle of papers by the blade edge 20 in the conventional driver as shown in FIG. 5, there is a problem that it is not possible to staple the bundle of papers by the leg portions being moved inwardly, and so on.

Moreover, in the staple 22 driven in the bundle of papers by the driver, particularly, there are problems that the crown 24 curves to project in an arch from the bundle of papers so that not only the sufficient stapling cannot be accomplished, but also the showing of a stapled portion is very bad, and the entire thickness of the bundle of papers due to a projected portion of the staple becomes larger even when stapling thin papers or the like, and when a plurality of stapled bundles of papers are stacked, by the projected portion of the staple in one bundle of papers, any paper in the other bundle of papers tears.

DISCLOSURE OF THE INVENTION

The present invention has been made in consideration of the above-mentioned problems, and an object thereof is to provide a driver structure for a stapler in which buckling of leg portion of a staple does not occur even when stapling a thick bundle of papers or a bundle of thick papers, and a crown between the leg portions of the staple is not projected in an arch, therefore it is possible to avoid circumstances in which the stapled portions become thick and the papers in the bundle tear, as described above.

To achieve the above object, a driver structure for a stapler according to the present invention comprises first projecting parts formed at opposite end portions on a pressing surface for pressing a staple having U-character shape including a pair of leg portions and a crown for connecting the pair of leg portions, the pair of leg portions being passed through a bundle of papers and configured to press the pair of leg portions perpendicularly, and second projecting parts disposed in the vicinity of the first projecting parts and configured to hold the crown in vicinity of the pair of leg portions when the pair of leg portions pass through the bundle of papers.

In one example, the first projecting parts have guiding surfaces contactable with outsides of the pair of leg portions in the vicinity of connecting portions between the pair of leg portions and the crown.

In the other embodiment, a third projecting part is provided between the second projecting parts to press the crown of the staple when the pair of leg portions pass through the bundle of papers.

The third projecting part comprises a crown pressing portion to press the crown.

BRIEF DESCRIPTION OF DRAWINGS

FIG. 5 is an explanatory view showing a conventional driver structure.

FIG. 6A is a perspective view showing a U-character shaped staple connecting unit.

FIG. 6B is a perspective view showing a sheet-like staple connecting unit.

BEST MODE FOR CARRYING OUT THE INVENTION

A best mode for a driver structure for a stapler according to the present invention will be explained with reference to the accompanying drawings below.

Figure 1:
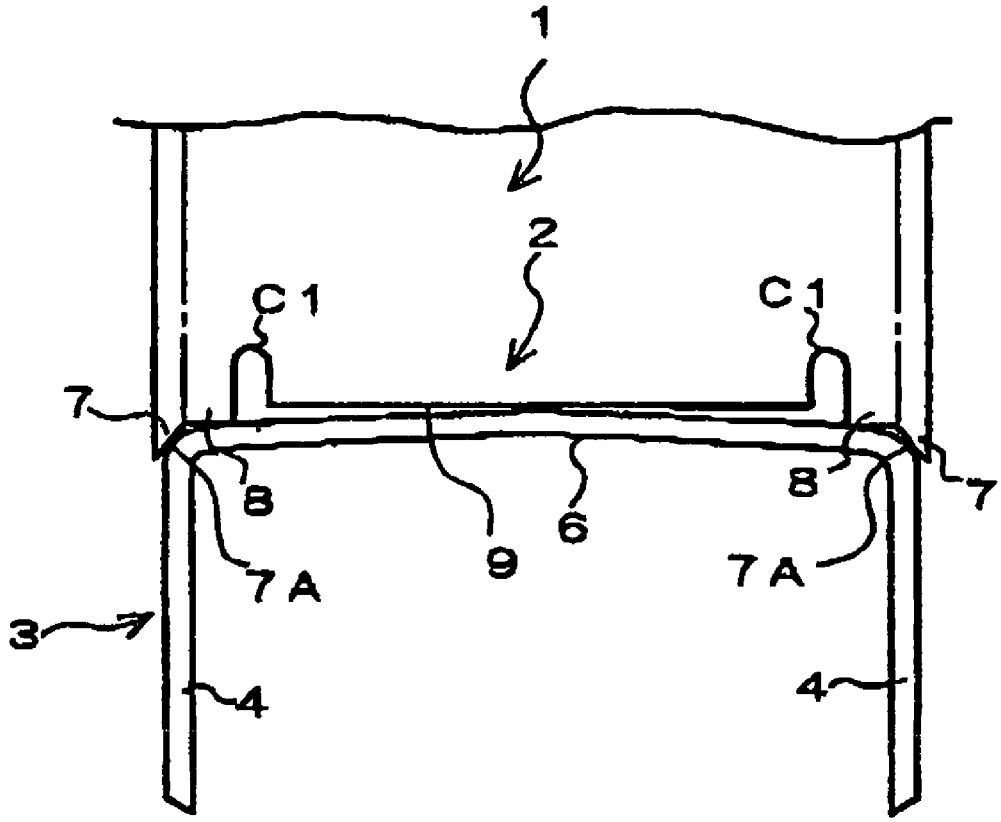
FIG. 1 is an explanatory view showing a driver structure for a stapler according to a first embodiment of the present invention.

FIG. 1 illustrates a blade edge of a driver for a stapler according to an embodiment of the best mode in the present invention. In FIG. 1, numeral 1 denotes the driver, the driver 1 comprises a driver for an electrically driven stapler provided in a stack-tray or the like, which sorts and holds a predetermined number of copy papers in a copying machine, for example. The staple 3 is disposed on an opposite side of the blade edge 2 of the driver 1. The staple has a U-character shape including a pair of leg portions 4 and 4, and a crown 6 for connecting the leg portions. A clincher (not shown) for bending inwardly the leg portions 4 and 4 is disposed on an opposite side of the driver 1 across the crown 6.

A staple connecting unit 5 (see FIG. 6A) in which a plurality of U-character shaped staples are arranged in parallel with respect to each other and adhered is disposed opposing to the blade edge 2 of the driver 1. Moreover, there is also a case of using a staple connecting unit 5' (see FIG. 6B) for the electrically driven stapler settled in the copying machine or the like, the unit being formed into a sheet to increase the number of staple to be loaded. In the electrically driven stapler, a staple 5'A positioning at a leading end of the staple connecting unit 5' in a feeding direction thereof is supplied beneath the blade edge 2 of the driver 1, and the staple is formed into a U-character shape and then the leg portions are configured to pass through a bundle of papers (not shown) and to staple the bundle.

The blade edge 2 of the driver 1 removes one staple from the staple connecting unit 5, the separated staple is bent into the U-character shape so as to form the leg portions 4 and 4, the leg portions are passed through copy papers (not shown), and the passed leg portions are bent by the cincher to staple the copy papers.

Meanwhile, the driver 1 is used for the electrically driven stapler set in the stack-tray in the copying machine, but may be used for a single electrically driven stapler or manually operated stapler. Because a driving mechanism of the driver 1 or a driving mechanism of the clincher is structured by a well-known mechanism, a detailed description thereof is omitted.

The blade edge 2 of the driver 1 is formed into a flat-plated portion having a thickness corresponding to a width of the crown 6 so as to pass the pair of leg portions 4 and 4 through the bundle of papers such as the copy papers by pressing the crown 6 of the U-character shaped staple 3.

Formed on opposite ends of the blade edge 2 of the driver 1 are first projecting parts 7 and 7, which press the pair of leg portions 4 and 4 while retaining opposite, ends of the crown inwardly. The first projecting parts 7 and 7 have guiding surfaces 7A and 7A for guiding outsides of the leg portions 4 and 4. Each of the guiding surfaces 7A and 7A has a base disposed beside a central portion of the crown 6 and a leading end inclined to position outside the crown 6. The guiding surfaces 7A and 7A of the first projecting parts 7 and 7 restrict possibility that leading ends of the leg portions 4 and 4 broaden outwardly when the leg portions 4 and 4 of the staple pass through the copy papers.

Second projecting parts 8 and 8 are formed in the vicinity of the first projecting parts 7 and 7 to develop effectively buckling-proof strength of the leg portions 4 and 4. Portions of the second projecting parts contacting with the crown 6 of the staple 3 are formed generally perpendicularly, the second projecting parts 8 and 8 are in engagement with the crown 6 when the leg portions 4 and 4 pass through the copy papers to prevent corners of the leg portions from slipping toward the central side of the crown 6.

Therefore, it is prevented that the leg portions are difficult to generate the buckling, when a thick bundle of papers or a bundle of thick papers are stapled, and the whole of the crown 6 is deflected in an arch-shape, when a thin bundle of papers or a bundle of thin papers are stapled.

Provided on a portion between the second projecting parts 8 and 8 is a crown pressing portion 9 as a third projecting part for pressing finally the crown 6, when the leg portions 4 and 4 of the staple 3 are bent along the copy papers, and cutouts C1 are formed between the second projecting parts 8, 8 and the crown pressing portion 9, respectively.

Figure 2:
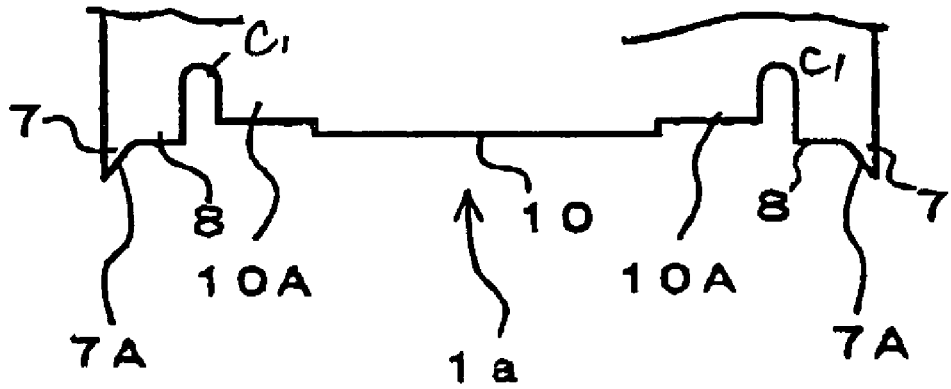
FIG. 2 is an explanatory view showing a driver structure for a stapler according to a second embodiment of the present invention.

In the driver 1*a* shown in FIG. 2, a crown pressing portion 10 as the third projecting part projects slightly from edges 10A of the cutouts C1 so that the central portion of the crown 6 of the staple 3 can be sufficiently pressed. Because the other structure is the same as in the driver shown in FIG. 1, a further description thereof is omitted.

Figure 3:
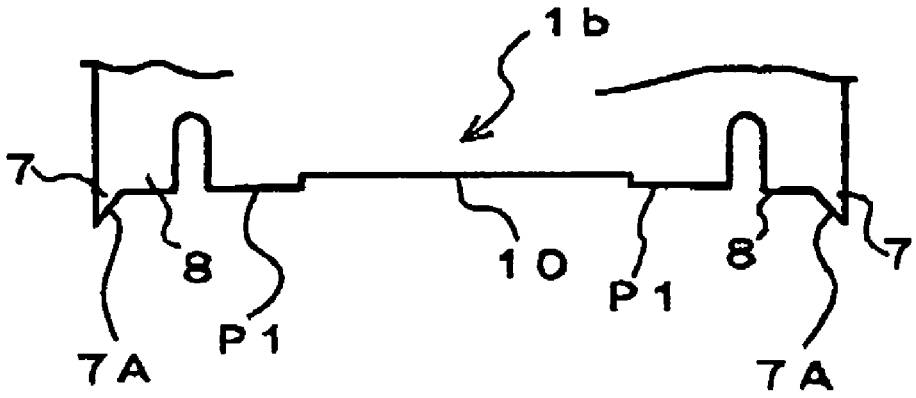
FIG. 3 is an explanatory view showing a driver structure for a stapler according to a third embodiment of the present invention.

FIG. 3 illustrates a driver 1*b* in a third embodiment in which projecting portions P1 and P1 are formed on portions near the second projecting parts 8 and 8. Each of the projecting portions P1 and P1 has a projected amount smaller than that of each of the second projecting portions 8 and 8 so that a slight space is formed between the crown 6 and the projecting portions P1, P1, when the second projecting portions 8 and 8 are engaged with the corners of the staple 3. Provided on a portion between the pair of projecting portions P1 and P1 is a crown pressing portion 10 as the third projecting part for pressing finally the crown 6 when the leg portions 4 and 4 of the staple 3 are bent along the copy papers.

By the first projecting parts 7, 7, the second projecting parts 8, 8 and the crown pressing portion 10 being provided, the whole of the crown 6 can be held by the first projecting parts 7, 7, the second projecting parts 8, 8 and the crown pressing portion 10 when stapling thin papers, hence the crown 6 can be further prevented from an arched deformation being generated.

Figure 4:
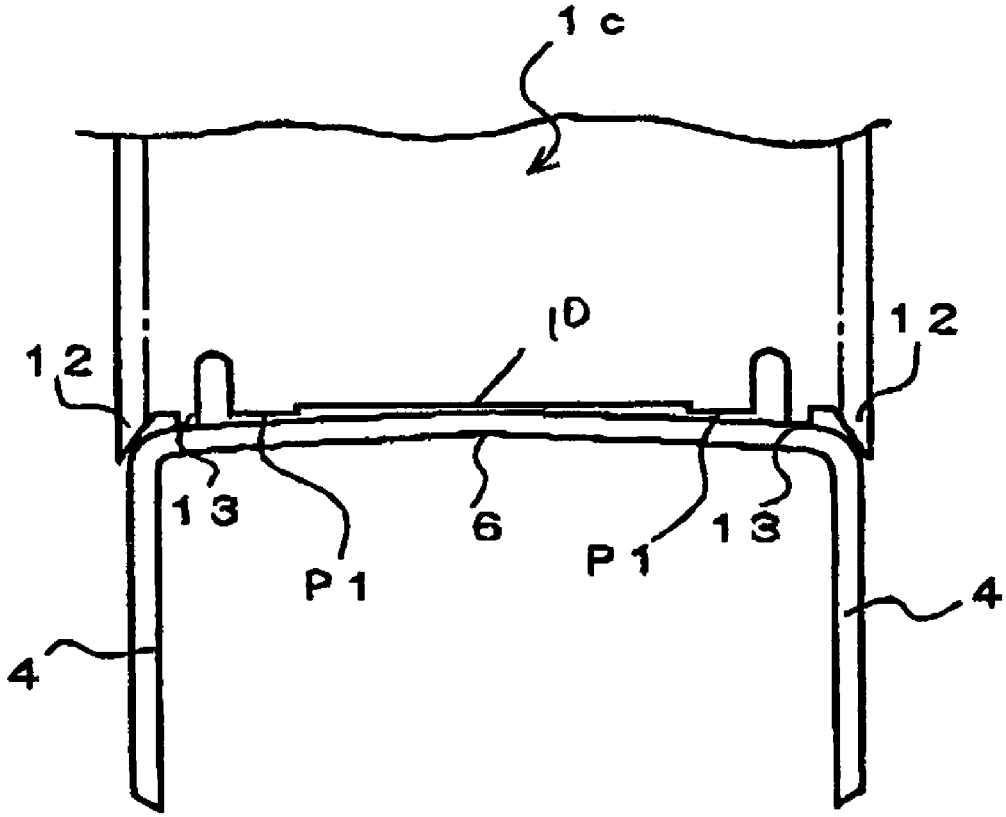
FIG. 4 is an explanatory view showing a driver structure for a stapler according to a fourth embodiment of the present invention.

FIG. 4 illustrates a driver 1*c* in a stapler according to a fourth embodiment. A blade edge of the driver is provided with second projecting parts 13 and 13 which are disposed inside first projecting parts 12 and 12 for engaging with portions near corners of the staple 3. The second projecting parts 13 and 13 are formed into a rectangular shape, and two corners of the second projecting parts 13 and 13 are configured to abut locally and strongly with the corners of the staple 3 when the leg portions 4 and 4 of the staple 3 pass through the bundle of papers.

By contacting locally the corners of the second projecting parts 13 and 13 with the corners of the staple 3 and holding these corners of the staple, the corners of the staple 3 are prevented from deforming toward the central portion of the crown 6, therefore the leg portions 4 and 4 of the staple 3 are difficult to generate the buckling, even if a thick bundle of papers or a bundle of thick papers is stapled, and the crown 6 of the staple 3 is prevented from generating the arched deformation, even if a thin bundle of papers or a bundle of thin papers is stapled.

The driver shown in FIG. 4 is formed with projecting portions P1 and P1 on the portions near the second projecting parts 13 and 13, similarly as the driver shown in FIG. 3, the projected amount of each of the projecting portions P1 and P1 is set to be less than that of the second projecting parts 13 and 13. A portion between the pair of projecting portions P1 and P1 is formed into a crown pressing portion 10 as the third projecting part to press the crown 6.

According to the driver structure for the stapler of the present invention, it is possible to bend the staple so that the buckling of the leg portions of the staple does not occur even when stapling the thick papers, the connecting portion between the leg portions of the staple is not deformed into an arch when stapling the thin papers.

APPLICABILITY IN INDUSTRY

According to the present invention, although it has been applied to the driver structure of the stapler for stapling the bundle of papers, it may be applied to the others, for example, to a driver structure in which a U-shaped nail is driven into a wood material.

The invention claimed is:

1. A driver structure configured to drive a U-character shaped staple including a pair of leg portions configured to pass through a bundle of papers and a crown for connecting the pair of leg portions, the driver structure comprising:

a blade edge disposed to be in contact with the staple;

a first pair of projections, each projection of said first pair being provided at an opposite end portion of the blade edge, and being disposed to be in contact with a corner formed between the crown and one of the leg portions for pressing the leg portion perpendicularly while retaining opposite ends of the crown inwardly when the leg portion passes through the bundle of papers;

a second pair of projections, each projection of said second pair being provided on the blade edge in vicinity of one of the projections of said first pair, and being configured to be in contact with the crown in vicinity of one of the leg portions when the leg portion passes through the bundle of papers; and a middle projection provided on the blade edge between the projections of said second pair, to hold the crown of the staple when the pair of leg portions pass through the bundle of papers, the middle projection comprising a crown pressing portion to press the crown; and cutouts formed between each projection of said second pair and the crown pressing portion to substantially form portions of each projection of said second pair contacting with the crown of the staple perpendicularly to be in engagement with the crown, wherein each projection of said second pair has a corner portion disposed adjacent to one of the corners of the staple, which engages with the crown and is configured to prevent the corner of the staple from slipping toward a central side of the crown, wherein each projection of said first pair has a guiding surface positioned at least partially outside of an outside edge of one of the leg portions, so as to guide said outside edge of the leg portion and restrict the broadening of a leading end of the leg portion when the leg portion of the staple passes through the bundle of papers, and wherein the crown is held by the first pair of projections, the second pair of projections and the crown pressing portion when stapling the bundle of papers.

* * * * *